United States Patent [19]

Hines et al.

[11] 4,407,337

[45] Oct. 4, 1983

[54] WIRE WRAPPING TOOL FOR WRAPPING INSULATED WIRE

[75] Inventors: Howard E. Hines, Ipswich; Rex F. G. Hardy, Woodbridge; David S. Butler, Saxmundham, all of England

[73] Assignee: Post Office, London, England

[21] Appl. No.: 406,882

[22] Filed: Aug. 10, 1982

Related U.S. Application Data

[63] Continuation of Ser. No. 140,561, Apr. 15, 1980, abandoned.

[30] Foreign Application Priority Data

Apr. 17, 1979 [GB] United Kingdom ..... 7913245

[51] Int. Cl.[3] ..... B21F 3/04

[52] U.S. Cl. ..... 140/124; 81/9.5 R; 242/7.06; 242/7.17

[58] Field of Search ..... 140/115, 122, 124; 29/751; 242/7.06, 7.17, 7.18; 81/9.5 R; 7/107, 158

[56] References Cited

U.S. PATENT DOCUMENTS

| | | | |
|---|---|---|---|
| 3,781,932 | 1/1974 | Baker et al. | 242/7.17 X |
| 3,967,661 | 7/1976 | Scoville et al. | 140/124 |
| 4,051,875 | 10/1977 | Baker et al. | 140/124 |
| 4,076,056 | 2/1978 | Dümmel | 140/124 X |

*Primary Examiner*—Fred Silverberg

*Attorney, Agent, or Firm*—Kemon & Estabrook

[57] ABSTRACT

A wire wrapping tool comprises a head which is formed integrally with a shaft. The head includes a frusto-conical portion which has a chordally extending portion cut away to define a cutting edge. A blade portion is formed on the head, the blade having a slot through which a wire can pass. The head also has an axially extending bore into which a wire wrapping post can be inserted. In use the shaft is attached to a pistol gun to rotate the head. Wire from which the insulation is to be stripped is passed over the edge, through the slot and around a wrapping post. As the wire passes over the edge a longitudinal slit is formed in the insulation which is then stripped away from the conductive core as the wire passes through the slot.

6 Claims, 6 Drawing Figures

WIRE WRAPPING TOOL FOR WRAPPING INSULATED WIRE

This is a continuation, of application Ser. No. 140,561, filed Apr. 15, 1980, now abandoned.

BACKGROUND OF THE INVENTION

This invention relates to the wrapping of electrically conductive wires. The invention particularly relates to the stripping of electrical insulation from insulated wires prior to the uninsulated wire being wrapped on a wrapping post.

Frequently it is necessary to wrap an electrically conductive wire around a wrapping post. The wires, for example telephone wires, have an outer insulating sheath which often has to be stripped from the wire prior to the wire being wrapped in order to enable a good contact to be established between the wire and the wrapping post. A known wrapping tool comprises a wrapping head which in use is located coaxially with the wrapping post so that it can be rotated about the wrapping post. The wrapping head carries a stripping plate which is positioned so that the wire to be wrapped passes through a stripping slot in the plate immediately prior to being wrapped on the post. The size of the slot is such that the central electrically conductive core can pass therethrough but the outer insulating sheath is removed by the plate. The head is generally formed with a shaft which can be connected to a conventional pistol gun for rotating the head. The shaft on the wrapping tool can if necessary be connected to the gun via a holder which includes a wire cutter for cutting the wire to a pre-selected length prior to wrapping.

This known type of wrapping head operates on the principle that in order to obtain a reliable wire wrap a high tension usually has to be introduced into the wrap during terminating particularly when the insulation material is foamed polyethylene. The high tension can be tolerated when dealing with copper conductors but can cause problems of wire breakage due to excessive tension when aluminium conductors are used.

We have now found that it is possible to strip and wrap wires with a reduced tension using a wrapping head which includes a cutting edge for inserting a cut into the insulation prior to the insulation being stripped by a stripping element.

SUMMARY OF THE INVENTION

According to the present invention there is provided a wire wrapping tool comprising a wrapping head adapted for rotation relative to a wrapping post, said head comprising a body defining a cutting edge, means for guiding a wire to be wrapped to said edge such that during operation of the tool the edge forms a cut in the insulation of the wire as the wire passes over said edge, and a stripping element including an opening through which said wire is adapted to pass after it has moved over said edge.

The head may be formed integrally with a shaft which is adapted to be linked to means for rotating the head.

The head may comprise a main body portion and said stripping element may comprise a chordally extending plate part which is formed on said main body portion and in which is formed a slot. An axially extending bore may be formed in the head from a position adjacent said plate portion, said bore being arranged to receive a wrapping post.

An arcuate surface of the head around said axially extending bore may be formed such that a circular line along said surface lies in a plane which is disposed at a small acute angle to a plane perpendicular to the axis of the head. The arcuate surface may also be formed such that it is inclined in a direction from its radially outer edge towards its radially inner edge at a small acute angle to a plane perpendicular to the axis of the head.

The invention will be described now by way of example only with particular reference to the accompanying drawings. In the drawings:

DESCRIPTION OF THE PREFERRED EMBODIMENT

Figure 1:
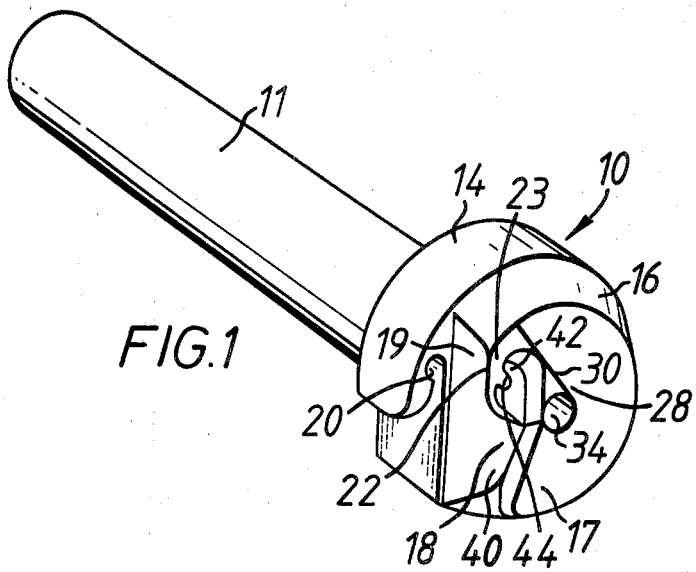
FIG. 1 is a perspective view of a wire wrapping tool in accordance with the present invention.

A wire wrapping tool comprises a wrapping head 10 which is formed integrally with a shaft 11 which extends coaxially with the head 10. The head 10 comprises a generally cylindrical first part 14 extending from the shaft 11, a generally frusto-conical second part 16 converging coaxially from the cylindrical part 14 and a third part 17 which terminates in a blade portion 18. The frusto-conical part 16 has a part segment thereof cut away, the chordally extending surface 19 formed thereby lying generally parallel to and spaced a small distance from the blade part 18. The cylindrical part 14 has a longitudinally extending slot 20 formed therein, the slot extending from a position adjacent the shaft 11 through the cylindrical part 14 and terminating adjacent the surface 19 formed by the cut away portion in the frusto-conical part 16. The upper edge 22 of the cut away part of the frusto-conical portion 16 is left sharp to define a splitting edge as will be described later.

The end surface of the frusto-conical part 16 has a portion 23 which extends from the edge 22 and is inclined at an angle of substantially 10° to a plane perpendicular to the axis of the tool. The portion 23 extends beneath the blade 18 and terminates adjacent an arcuately extending ramp 28 which rises uniformly from its position 30 adjacent the portion 23 upwardly to the blade part 18. The ramp 28 rises at substantially 5° to a plane perpendicular to the axis of the shaft 11 and the surface of the ramp is inclined from its radially outer edge towards its radially inner edge at an angle of 10° to such a plane, the inclination being such that the radially inner edge is closer to the shaft 11 than the radially outer edge.

An axially extending bore 34 is formed in the head and extends through the head 10 from a position adjacent the ramp 28 and into the shaft 11. The bore 34 is provided to receive a wrapping post on which wire is to be wrapped.

Figure 5:
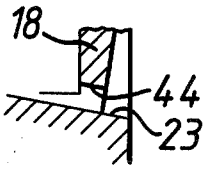
FIG. 5 is a section on the line A-A of FIG. 3.

The blade portion 18 has a first end part 40 which merges into the frusto-conical portion and a second part 42 which is spaced from the frusto-conical part. Intermediate the first and second end portions is formed a slot 44 which is also shown in cross-section in FIG. 5. The upper surface of the slot has an inclination corresponding to that of the portion 23.

The upper surface of the blade portion 18 has a first part 25 which extends perpendicularly to the axis of the shaft, a second part 26 extending from the first part at an angle of 20° to the first part and terminating adjacent the upper end of the ramp 28, and a third part 27 extending from the second part to the cylindrical part 14 at an angle of 25° to the shaft axis.

In operation the shaft 11 is linked to a conventional pistol type gun for rotating the head 10. The connection may be via way of a holder which includes a cutter for cutting wire which is to be wrapped to a predetermined length. Such cutters and guns are known and will not be described in detail here.

Figure 2:
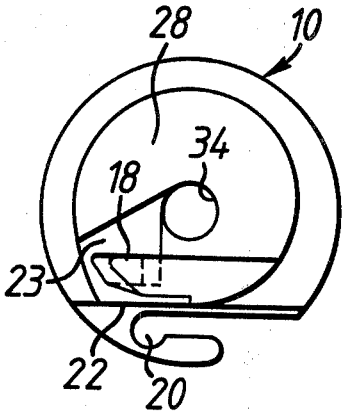
FIG. 2 is a plan view of the wrapping head.
Figure 6:
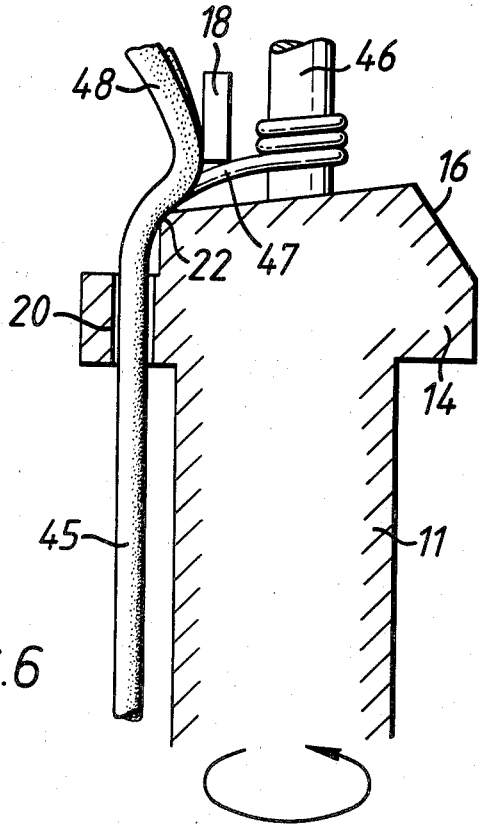
FIG. 6 is a schematic side elevation illustrating the operation of the tool.
Figure 3:
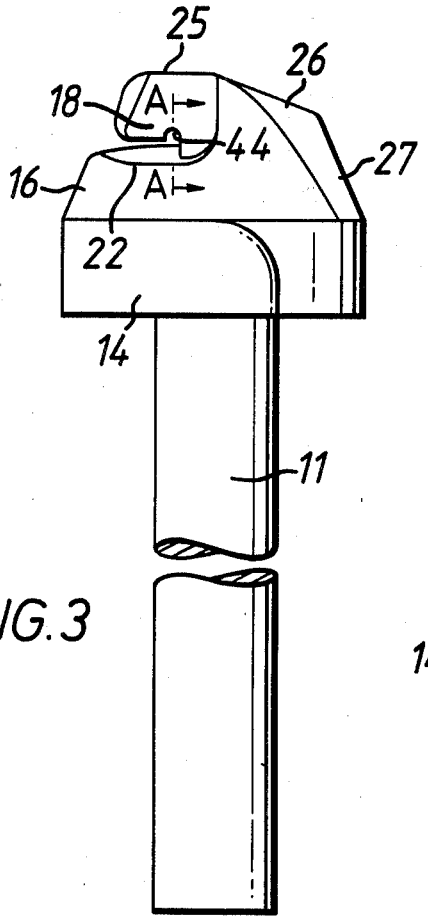
FIG. 3 is a first side elevation of the wrapping head.
Figure 4:
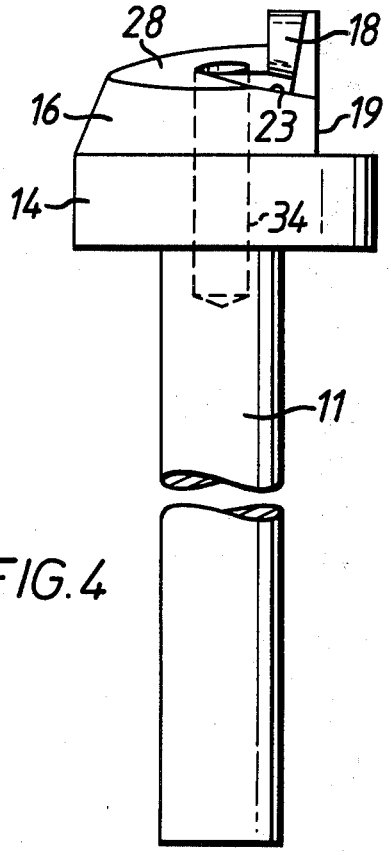
FIG. 4 is a second side elevation of the wrapping head.

Wire 45 which is to be wrapped is passed under a wrapping post 46 (FIG. 6) and along the side thereof. The head 10 is then placed around the post so that the post enters the bore 34 as shown in FIG. 6. The wire 45 is pulled into the slot 44 in the stripping plate 18, over the splitting edge 22 and into the slot 20. The size of the slot 44 in the blade is such that it will allow the electrically conductive core 47 to pass through but will not allow passage of the outer insulating sleeve 48. The wire is held taut and layed into the cutter blades of a cutter between the wrapping tool and the gun. The head 10 is then rotated relative to the post by operation of the gun. This causes the wire 45 to be drawn over the edge 22 and through the slot 44 in the blade 18. As the wire is drawn over the edge 22, the edge splits the insulation forming a longitudinal slit in the insulation 48 which is then stripped away from the central conductive core 47 by the blade 18 as illustrated in FIG. 6. Thus when the core 47 emerges from the slot 44 in the blade it is completely free of insulating sleeve. As viewed in FIG. 2 the wire passes clockwise around the post and along the surface of the ramp 28. The ramp 28 rises at approximately 5° as previously described and this inclination together with the relative position of the edge 22 and blade 18 result in the exposed wire approaching the post 46 at an angle corresponding substantially to the pitch of helix with which the wire is wrapped around the wrapping post 46. This assists wrapping of the wire around the post and prevents successive turns overlapping. The 10° slope of the surface of the ramp 28 previously referred to is partly a manufacturing consideration.

An important feature of the head is the edge 22 which forms the slit in the insulation prior to the insulation being completely stripped away by the blade. The provision of the edge 22 to provide the initial cut in the insulation enables much lower tensions to be used in wrapping than have previously been necessary. This allows aluminium conductors to be wrapped without the danger of the aluminium breaking.

The slot 20 serves to guide the wire over the edge and into the slot 44.

The wire wrapping tool can be made from silver steel.

We claim:

1. A wire wrapping tool comprising a wrapping head adapted for rotation relative to a wrapping post, said head having separate cutting and separate stripping means for removing insulation from a wire and means for guiding wire to be wrapped to said cutting and stripping means, characterized in that the cutting means comprises a cutting edge defined on said head and the stripping means comprises a stripping element disposed downstream from the cutting edge such that in use the wire passes over the cutting edge before reaching the stripping means, the cutting edge and stripping element being arranged generally transverse to the direction of movement of the wire, and the cutting edge being arranged to form a straight longitudinal cut in the insulation on the wire prior to it being stripped by the stripping element.

2. A wire wrapping tool as claimed in claim 1 wherein said head is formed integrally with a shaft which is adapted to be linked to means for rotating the head.

3. A wire wrapping tool as claimed in claim 1 wherein said head comprises a main body portion and said stripping element comprises a chordally extending plate part which is formed on said main body portion and a slot formed in said chordally extending plate part.

4. A wire wrapping tool as claimed in claim 3 wherein an axially extending bore is formed in said head from a position adjacent said plate part, said bore being arranged to receive a wrapping post.

5. A wire wrapping tool as claimed in claim 4 wherein an arcuate surface of the head around said bore is formed such that a circular line along said surface lies in a plane which is disposed at a small acute angle to a plane perpendicular to the axis of the head.

6. A wire wrapping tool as claimed in claim 5 wherein the arcuate surface is also formed such that it is inclined in a direction from its radially outer edge towards its radially inner edge at a small acute angle to a plane perpendicular to the axis of the head.

* * * * *